United States Patent [19]

Fitzgerald, John J. et al.

[11] Patent Number: 4,863,132

[45] Date of Patent: Sep. 5, 1989

[54] SAFETY RESTRAINT BRACKET

[76] Inventors: Fitzgerald, John J., 17650 Daves Ave., Monte Sereno, Calif. 95030; Michael B. Fitzgerald, 25799 Ave. 18½, Madera, Calif. 93638

[21] Appl. No.: 281,959

[22] Filed: Dec. 5, 1988

Related U.S. Application Data

[63] Continuation of Ser. No. 127,936, Dec. 2, 1987, abandoned.

[51] Int. Cl.[4] ..... E04G 3/00

[52] U.S. Cl. ..... 248/274; 248/205.3; 248/231.91; 312/245

[58] Field of Search ..... 248/274, 205.1, 205.3, 248/231.91, 298; 292/251, 291; 312/245

[56] References Cited

U.S. PATENT DOCUMENTS

| | | | |
|---|---|---|---|
| 1,106,909 | 8/1914 | Zifferer | 248/231.91 |
| 2,541,434 | 2/1951 | Nelson et al. | 248/274 |
| 3,946,979 | 3/1976 | Ehlebracht et al. | 248/274 |
| 3,969,620 | 7/1976 | Brooks | 248/274 X |
| 4,659,047 | 4/1987 | Haller | 248/274 |

*Primary Examiner*—Ramon O. Ramirez

[57] ABSTRACT

This invention relates to a safety restraint bracket of functionally interchangeable components for constraining freestanding appliances and furnishings. A malleable and machine scored parent plate can be joined with a mating plate to form a fastening clamp. This clamp assembly is wedded to a freestanding article or structure using an insulating cohesive foam bedding with supplemental mechanical fastenings. A spanning component, adjustable in effective length, firmly bridges from the installed clamp to an anchorage plate fastened to a buttressing adjacent surface such as a substantial wall.

3 Claims, 1 Drawing Sheet

SAFETY RESTRAINT BRACKET

This application is a continuation of Ser. No. 127,936 filed 12/2/87 abandoned.

BACKGROUND OF THE INVENTION

This invention relates to certain new and useful improvements of safety restraint bracket assemblages for securing free standing appliances. Uniqueness of design lies in the development of the present invention to restrain profile configurations commonly seen in free-standing cabinetry, appliances, tables, computers, furnishings and the like.

Various embodiments of simular type restraint brackets are known.

As will be recognized the violent displacement of free standing appliances, furnishings and the like experienced during severe earthquakes will place extreme shear loading on restraint brackets installed to suppress motion. the prior art forms do not anticipate the evolvement of appliances, computers, furnishings of more complex curved and angulous profile configurations. Though the prior art forms describe adjustability, generally they are limited in the scope of grasp and lack flexibility permitted by the functional interchangeability of components.

The present invention, referring a safety restraint bracket assembly of interchangeable components, is described by example only. This safety restraint bracket could be described as a holding assemblage of coacting components with an elongated tractable, end flanged, member having scoring athwart the longitudinal axis. This elongated plate is combined with a second mating rectangular constituent segment with a perpendicular deflected portion forming a flange on an extreme end. Each of these members are fabricated with a plurality of utility fastening and alignment holes. Wedding these plate units forms a substantial boss used to attach a transverse bridging component used as an alignment locator spanning to a rectangular or trapizoidal plate anchored to an essentially stationary adjacent surface. It is found that the present invention anticipates the discribed prior art problems by the use of developments in cohesive foam bedding as an electrical nonconductor and resilient vibration cushion sound dampner with component malleability and interchangeability of the invention components.

It is the intention of this invention to provide a functional, straight forward safety restraint bracket of uncomplicated design which by means of the transverse bridging component between a relatively stable anchorage holds a freestanding appliance relatively static. Other attendent advantages of the invention in use would be the suppression and dampening of energy distention and countering physical displantation.

Other objects and advantages will become apparent from the following description.

SUMMARY OF THE INVENTION

Components of the invention are by design interchangeable in their use. Where one aspect of the assembly would include a scored, elongated rectangular malleable plate having a turned flange at one extreme end for the purpose of being mechanically and cohesive bedded relatively perpendicular to a mating plate thereby forming a right angle clamp. The right angle clamp being coated, on the surface contiguous to the workpiece restrained by state of the art chemically cohesive non electrical conducting foam bedding and having a pattern of through holes for mechanical fastenings. The cohesive foam bedding also being a resilient, vibration cushion sound dampner.

A boss appropriately formed by an extension of the clamp engages a mechanically fixed transverse bridging component extending bilaterally outword from the boss. The transverse bridging component being functionally adjustable in effective length extends and mechanically secures to an anchor plate substantially secured to an stationary adjacent surface. The transverse bridging component connecting the appliance to the anchorage results in dampening energy distention, countering physical displantation thus holding the safety restraint bracket and appliance relatively static.

BRIEF DESCRIPTION OF THE DRAWINGS

This invention is now elaborated by way of example only, and in reference to associated drawings, wherein.

DESCRIPTION OF THE PREFERRED EMBODIMENTS

This invention is described by way of example only in reference to the fore mentioned drawings. The invention will be described as a safety restraint bracket assembly and can be used in other applications as will be appreciated.

In reference to the accompanying drawings, wherein like numbers are used to indicate like parts to facilitate the description.

The restraint assembly 6 of the present invention would be appropriately fabricated of metal, this is by example only since any suitable material could be used.

Figure 4:
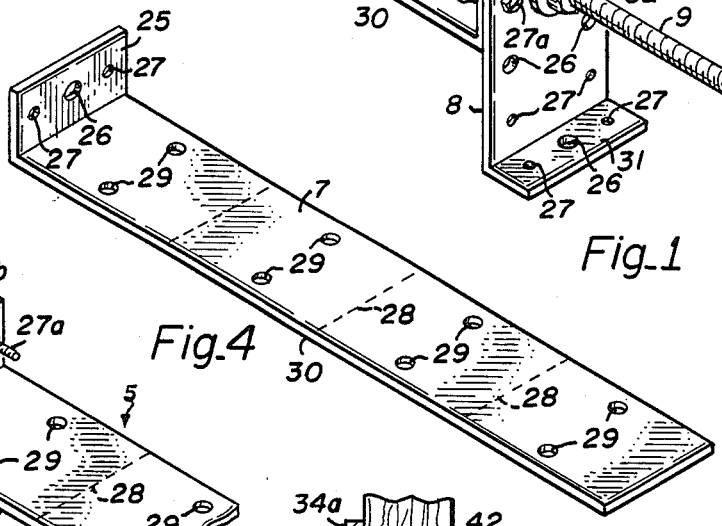
FIG. 4: is a perspective view of the parent plate showing the approximately ninety degree flange at one extreme end, chemically cohesive foam bedding, holes for mechanical fastening and machine scoring is also delineated.
Figure 5:
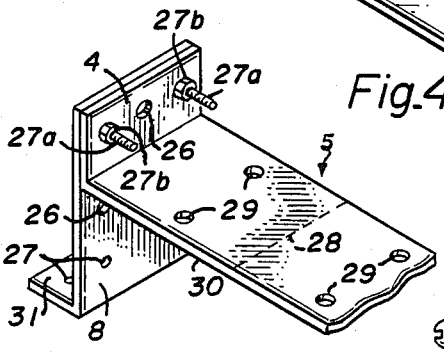
FIG. 5: is a perspective partial view of the assembled parent plate with the mating plate showing the chemically cohesive foam bedding and elaborating the boss formed by these components.

The restraint assembly 6 includes a plurality of machine scoring 28 facilitating the segmentation of a parent plate 7 shown as a rectangular or trapezoidal flat member in FIG. 4 with a flange 25 perpendicular to the upper surface. Malleability allows the conformation of parent plate 7 to curved or angulous surfaces, the underside cohesive foam bedding 30 then being contiguous to the flat, curved or angulous surface of a restrained appliance or furnishing (not shown).

An angular flange 25 is located at an extreme end of parent plate 7, flange 25 being provided with at least one mounting hole 26 illustrated in FIG. 4 of such diameter to permit passing therethrough of a transverse bridging component 9 (to be described hereinafter). Flange 25 being provided with a plurality of holes 27 therein for the alignment thereof and fastening to the mating plate 8 with through fasteners 27*a* passing therethrough forming an angle clamp 5.

Referring further to restraint assembly 6 of the accompanying drawings a plurality of mounting holes 29 is provided as a means of securing a parent plate 7 to a receptive surface by passing nails, screws, bolts, nonelectrical conducting nylon bolts or the like through mounting holes 29.

The chemically cohesive foam bedding 30 surface of angle clamp 5 using nylon or plastic fastenings has a nonelectrical conducting characteristic between angle clamp 5 and contiguous surfaces. Also the applied cohesive foam bedding of angle clamp 5 acts as a resilent vibration cushion which dampens sound oscillations.

A mating plate 8 is fabricated with a turned flange 31 at an extreme end having at least one mounting hole 26 for the purpose of passing a transverse bridging component 9 therethrough, mating plate 8 also having a plurality of mounting holes 27 in conjunction with mounting hole 26 essentially forming an hole pattern as shown in singular form in FIG. 4 flange 25. The extreme opposite end of a mating plate 8 is fabricated showing a trilateral pattern of at least three mounting holes 26 and a plurality of a mounting holes 27, essentially forming a trilateral pattern of the basic hole pattern shown in FIG. 4 flange 25. The reverse (backside) of mating plate 8 having an cohesive foam bedding 30 that cohesively beds with flange 25 and forms one lateral of the aforementioned clamp 5. A separation paper shield 37 having the capability of negating the effect of the cohesive foam bedding when left in contact thereto.

The restraint assembly 6 having at least one (helical optional) transverse bridging component 9 inserted therethrough a boss 4 formed by a conjunction of aligned mounting holes 26 in flange 25 and a selected mounting hole 26 in the hole pattern in a mating plate 8.

The transverse bridging component 9 being essentially fixed to boss 4 by nut 32 and washer 33 fixed on the opposing sides of boss 4 and transverse bridging component 9 having functional spacing capabilities to alter the effective distance between clamp 5 and wall plate 34.

Aligning and contiguous fixing of the parent plate 7, flange 25 had a mating plate 8 hole 26 in the hole pattern is attained by cohesive foam bedding 30 and bolts 27*a* with nuts 27*b* therethrough. Further, a parent plate 7 of somewhat malleable characteristics and mating plate 8 form clamp 5 for attaching to an appliance or furnishing (not shown) by means of cohesive foam bedding 30. As will be appreciated the selective use of a particular combination of holes 26 is inferred when considering the multi-directional capability and versital characteristics of component composition on the present invention.

Figure 2:
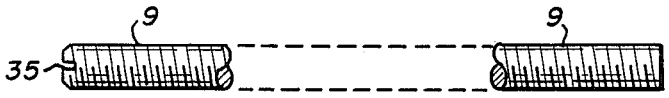
FIG. 2: is a fragmented sectional view of the (optionally helical) transverse bridging component of the present invention.
Figure 1:
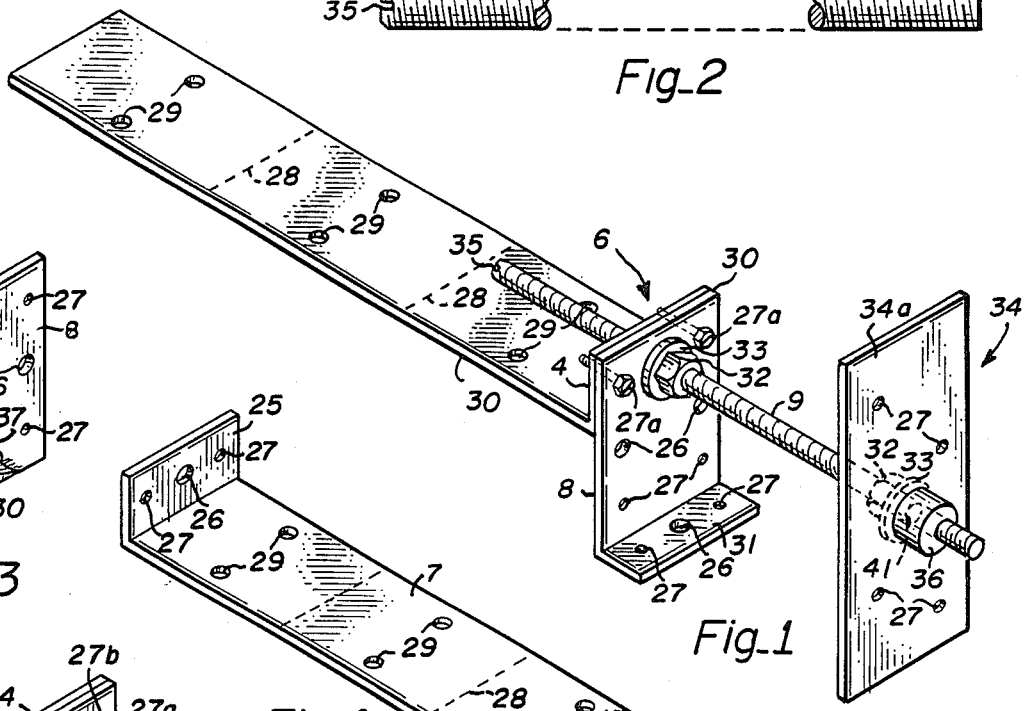
FIG. 1: is a perspective view of a suggested assembly according to one form of the invention.
Figure 3:
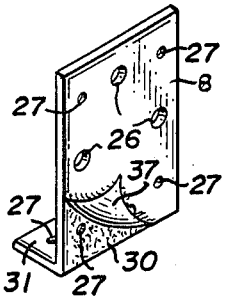
FIG. 3: is a perspective (reverse) view of the mating plating showing the mating plate hole pattern, chemically cohesive foam bedding, and approximately ninety degree flange at one extreme end.

In reference to FIG. 1, a transverse bridging component 9 being fixed in the fore mentioned boss 4 by means of spin on nuts 32 and washers 33 in place on opposing sides. A wall plate 34*a* is fitted with pressed fit nut 36 within hole 41 permitting a transverse bridging component 9 to be fastened therein and whereas nut 32 and washer 33 are fixed to transverse bridging component 9 (in opposition to pressed nut 36) at the reverse side of wall plate assembly 34 essentially locking transverse bridging component 9 and wall plate assembly 34 as a unit.

Transverse bridging component 9, a regid component, fixes relatively static angle clamp 5 to wall plate assembly 34, this dampens energy distention at the restrant assemblage and counters physical displantation between the restrained appliance and abutment 38.

Figure 6:
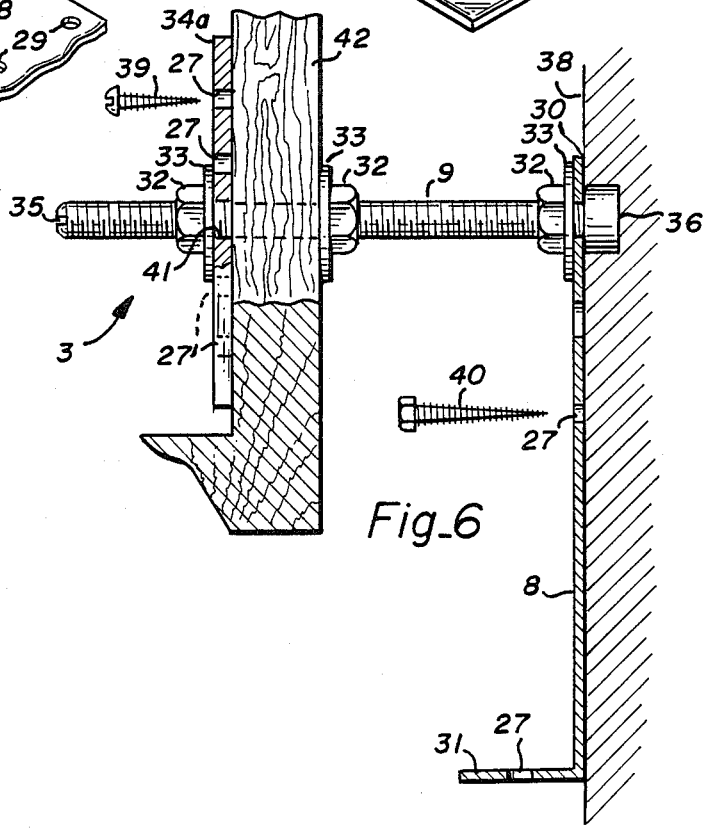
FIG. 6: is a fragmented section view showing an alternate assembly according to one form of the present invention.

FIG. 6 elaborates by way of example only an optional installation of the present invention using screws 39 into cabnetry 42 and fastening screws 40 into a wall stud or abutment 38.

Referring further to FIG. 6 the restraint bracket assembly 3 having at least one wall plate 34*a* with a generally centrally located hole 41 to receive a transverse bridging component 9 therethrough, being essentially locked in place on opposing sides, of the combined thickness of cabinet 42 and wall plate 34*a* by nuts 32 and washers 33. In use, suitable securing means such as screw 39 or the like are passed through holes 27 to attach wall plate 34*a* to cabinet 42. lateral extension of a transverse bridging component 9 is located as unit to a mating plate 8 by the assembly of press nut 36 to transverse bridging component 9 on the reverse (backside) of a mating plate 8 and on the opposing face by nut 32 and washer 33. Mating plate 8 having cohesive foam bedding 30 in conjunction with a plurality of mounting holes 27 for securing by means of fasteners 40 or the like to abutment 38.

A tool aperture 35 is provided at one extreme end of transverse bridging component 9 to aid in assembling a safety restraint bracket.

We claim:

1. A safety restraint bracket for constraining an article or structure consisting of:

a holding assemblage of coacting components including an elongate tractable member having scoring athwart its longitudinal axis and an upward indicating, generally perpendicular deflected portion at one extreme narrow end, said elongate tractable member having a plurality of fastening apertures for means of alignment with mating surfaces and affixing thereto, said elongate tractable member having a coated plane of cohesive foam bedding as means of an electrical nonconductor and resilient vibration cushioning sound damper, said holding assemblage also includes an essentially rectangular constituent segment having a generally perpendicular deflected portion at one extreme end of the major plane, said rectangular constituent segment having a plurality of apertures for means of alignment with mating surfaces and for affixing thereto effectively forming a substantial boss, said rectangular constituent segment having a coated plane of cohesive foam bedding as means of an electrical nonconductor and resilient vibration cushioning sound dampner, a transverse bridging component as a functional means of holding relatively static at said boss of the said holding assemblage and used as an alignment locator for stabilizing, and a generally rectangular or trapizoidial member, said rectangular or trapizoidal member having an opening as means of linear localization of the said transverse bridging component and of embracing said transverse bridging component in a relatively established position, said generally rectangular or trapizoidal member having a plurality of holes as means of passing a fastener therethrough and anchoring to an essentially stationary adjacent surface.

2. A safety restraint bracket for constraining an article or structure as defined in claim 1 wherein said cohesive foam bedding also secure the tractable elongated member to a flat curved or angulous surface of said article or structure.

3. A safety retraint bracket for constraining an article or structure as defined in claim 1 and means for adjusting the functional length of its transverse bridging component, this means includes helical ridges and grooves.

* * * * *